US009709004B2

(12) United States Patent
James

(10) Patent No.: US 9,709,004 B2
(45) Date of Patent: Jul. 18, 2017

(54) SINGLE BARREL CARBURETOR

(71) Applicant: Patrick Lee James, Wellington, FL (US)

(72) Inventor: Patrick Lee James, Wellington, FL (US)

( * ) Notice: Subject to any disclaimer, the term of this patent is extended or adjusted under 35 U.S.C. 154(b) by 533 days.

(21) Appl. No.: 14/544,856

(22) Filed: Sep. 16, 2013

(65) Prior Publication Data

US 2015/0233325 A1 Aug. 20, 2015

(51) Int. Cl.
*F02M 19/02* (2006.01)
*F02M 11/02* (2006.01)

(52) U.S. Cl.
CPC ..... *F02M 19/02* (2013.01); *F02M 11/02* (2013.01)

(58) Field of Classification Search
CPC ..... F02M 19/02; F02M 19/06; F02M 19/08
USPC ..... 261/23.2, 66
See application file for complete search history.

(56) References Cited

U.S. PATENT DOCUMENTS 6,446,939 B1 * 9/2002 Hoppe ..... F02M 17/04 261/35

* cited by examiner

*Primary Examiner* — Robert A Hopkins

(57) ABSTRACT

A carburetor main body assembly for an engine has a main body. The main body has a single body passage and a single throttle plate. The single body passage has a single intake port and a single discharge port. The single intake port is connected to the single discharge port. The single discharge port is connected to a plenum of the engine. The single throttle plate is disposed within the single body passage. The throttle plate is operable to regulate airflow through the single body passage. The main body further has a first section to supply fuel to the engine and a second section to supply fuel to the engine. The first section is independent in operation from the second section. The first section is a first quadrant. The second section is a second quadrant.

16 Claims, 4 Drawing Sheets

SINGLE BARREL CARBURETOR

FIELD OF THE INVENTION

This invention relates generally to the field of carburetors for internal combustion engines. More specifically, this invention relates to a single barrel down draft carburetor for air demand engines.

BACKGROUND OF THE INVENTION

High air demand and high horsepower per cubic inch engines, like most internal combustion engines, require a proper mixture of fuel and air to be fed into the combustion chamber of the cylinders and these fuel to air ratios and fuel curve requirements can change for each section of the engine at both idle and at each range of the engines rpm band and even during different positions of the carburetors throttle valve (throttle blade) position. A common device for regulating the air/fuel mixture and delivering it to the combustion chamber is a carburetor. The carburetor controls the engine's fuel and air input and therefore greatly influences power output. The carburetor mixes fuel and air in the correct proportions for the engines rpm (revolutions per minute) and for the engine's varying load. The carburetor atomizes and vaporizes the fuel/air mixture to facilitate combustion. While fuel injection has replaced carburetors in many of today's vehicles, carburetors continue to be used in high performance vehicles (i.e., race cars) particularly where space, cost, or performance preferences dictate. Carburetors often have the same basic structure: a fuel inlet and reservoir (the fuel bowl assembly), which takes in and holds fuel for metering in the proper proportions; a main body, including a throttle valve (throttle blade) an air passage, which admits air in one end and discharges the fuel/air mixture from the other; and one or more fluid circuits connecting the fuel bowl assembly to the main body. The actual design and orientation of the structures varies widely depending on the size, configuration, and performance needs of the engine.

Engine's may employ many types of carburetor designs. The most popular example is the four barrel carburetor registered under U.S. Pat. No. 2,892,622 Inventor: C. R. Goodyear, Assignee: Holley Carburetor Company. A similar design for this patent application is shown in U.S. Pat. No. 4,670,195 issued to Robson; Richard E. G. (referred to herein as the Robson design). The mission of the Robson design appears to be that it was to simply improve fuel atomization. But different engine cylinders also require different ratios at different engine rpms for proper operation. The Robson design does not serve the engines particular requirements as it does not have the capability to alter the fuel curve for each quadrant of the single barrel. Prior art single venturi designs as shown in U.S. Pat. No. 3,758,082 issued to Kertell, did offer quadrant tuning of the venturi but once again did not offer quadrant tuning of the air to fuel ratio curve now did it allow for quadrant tuning of the idle air to fuel mixture. These missing capabilities are required on larger single barrel carburetors and especially when used on higher horsepower per cubic in engines as they are more sensitive and have more exacting demands in their engines air to fuel ratio needs. A carburetor without these air to fuel ratio tuning capabilities is unusable on a high horsepower per cubic inch engine. Higher powered engine's create more heat or less heat in some areas of the engine cylinder's and those hotter or cooler cylinder's will require richer or leaner air to fuel ratios as engine rpms vary. Also prior art did not have the capability of changing this air to fuel ratio curve as it exits the boosters as the engine rpms, engine loading and even the throttle blade/valve position is changed. An air to fuel ratio curve is an actual change in air to fuel ratio as the engine rpms increase or decrease. As an example, a typical performance engine tuned for maximum power will require a 13:1 air to fuel ratio. 13 parts air to 1 part fuel. But at lower rpms one section of the engine may require a ratio of 12.5:1 to keep it from detonating due to that section of the engine being hotter or other combustion effects.

However, since the introduction of larger single blade carburetors a need has been discovered for a true quadrant tunable single blade carburetors to meet the higher powered engines demands. True quadrant tuning of the metered fuel is especially required on larger single throttle blade designs, as during part throttle operation, the large single throttle blade design has an inherent flaw in that this much larger throttle blade will gather the bulk of the fuel that exits the boosters. This fuel will then roll down the back of the throttle blade and be distributed solely to the rear of the engine, making it run poorly due to excessive fuel being distributed to the rear and less fuel being distributed to the front during part throttle operation. So to remedy this condition, the rear quadrant of the booster (that distributes fuel into the rear portion of the single venturi) needs to be separately tunable to correct this issue. By utilizing a separate metering system, the single venturi design is to be calibrated to be much leaner during part throttle operation in the rear quadrant (the area of the venturi where the throttle blade drops down as the throttle blade is opened), so less fuel will run down the throttle blade during part throttle operation and will be distributed to the rear of the venturi during lower air speeds and part throttle operation. Consequently the front portion of the quadrant (the area where the throttle blade rises) needs to be tuned to be much richer (exactly the opposite direction to the rear quadrants needs) to remedy the situation created by the larger throttle blade robbing the fuel from the front quadrant of the venture during part throttle operation. However, when the throttle blade is rotated to a more vertical wide open throttle position, the fuel distribution in the single venturi needs to be once again restored to a more even air to fuel ratio as it exits the boosters. This is important to avoid the engine from now being too lean in the rear and too rich in the front during wide open throttle operation. The same issue apply when metering idle fuel into the engine.

The much larger blade requires that all four quadrants of the venture be fed and individually controlled in order to evenly supply idle fuel into the engine. Without this capability, the larger throttle blade design will only supply air to the rear of the engine and the engine will not ingest fuel into the rear cylinders and will not idle or will not idle properly. Prior art single venturi designs did not have an actual metering system that allowed these important tuning functions and prior art designs that incorporated a much smaller throttle blade probably did not require these capabilities. Prior art single barrel designs such as the Kertell design did allow the booster to be tuned to supply various amounts of fuel to each quadrant of the venturi but only in the area of having the ability to supply the same air to fuel ratio curve to the whole booster cluster. The Kertell design could in fact lean out the rear of the booster or a left rear quadrant of the booster, but it would maintain that same ratio at all times. The Kertell and other prior art single venturi designs do not allow each divided section of its single venturis' booster supplied fuel to be tuned to supply different volumes of fuel to each divided section of the booster at different air speeds (air/fuel ratio curve) nor did they allow each quadrant of the throttle blades perimeter to have controllable idle and transfer fuel (transfer fuel is fuel supplied during light part throttle operation). As a result those designs are incapable of properly controlling a larger single throttle blade carburetor design and filling the engine's needs.

Carburetors on performance engines disclosed in the aforementioned U.S. Pat. No. 2,892,622, have conventionally been of the four barrel type. This four barrel arrangement was to allow for better control of the engines quadrants. These four barrel carburetors were designed to supply the appropriate amount of air and fuel to each quadrant of the engine and by utilizing multiple metering systems it allowed for more precise tailoring of the engine's needs at varying loads, throttle positions and engine rpms. This is often a difficult task even with four barrel design carburetors. However, large single passage carburetors showed less eddy resistance (increased flow versus area) but these prior art single passage (single barrel) designs could not be built to allow for proper control of the air to fuel delivery process as a need was there for correcting the distribution of fuel into the intake manifold and the custom tailoring of the air to fuel ratio curve of each of the engines cylinders during varying loads, throttle blade/valve positions and engine rpms. This fuel curve and air to fuel ratio correction ability is required on any performance engine for maximum power and reliability as well as fuel economy. The intake manifold for the engines different cylinders are usually of different lengths and the fuel is not typically distributed evenly and this created a problem for large single barrel carburetors. A high horsepower per cubic inch multi cylinder engine will store and create various amounts of heat in each cylinder and as a result of its design, will require more or less fuel to be supplied to those hotter or cooler cylinders for maximum performance at varying loads and engine rpms to avoid damage. One solution proposed by U.S. Pat. No. 4,204,585 to Tsuboi et al., incorporated herein by reference, proposes using a carburetor for each cylinder of the engine in the case of a multi-cylinder engine. But this increases the complexity of the package, as well as requires accommodation in the engine envelope, which may already be cramped. This new design corrects the prior art single barrel carburetor designs inability to properly feed a high performance engine. It now has the ability to not only correct its air to fuel ratio (which prior art has employed) for each cylinder but it takes it a required step further and also incorporates a separate and completely independent metering system for each quadrant that allows for a change in the carburetor's air to fuel ratio curve for each divided section of the venture, at idle, transfer, part throttle and during wide open throttle operation. Prior art has not included a separate metering system for each quadrant of the venture nor has prior art even been equipped with an adjustable idle mixture system for each quadrant of the single barrel. These are options that present designs can achieve in four barrel carburetor designs, but have never been employed by prior art in a single barrel design as the complexity of incorporating them into the design was not solved by the prior art.

SUMMARY OF THE INVENTION

A carburetor main body assembly for an engine may include a main body having a single body passage having a single intake port connected to a single discharge port, the discharge port for connecting to a plenum of the engine and a single throttle plate disposed within the single body passage, the throttle plate operable to regulate airflow through the body passage.

The main body may include a first section to supply fuel to the engine and a second section to supply fuel to the engine and then the first section may be independent in operation from the second section.

The first section may be a first quadrant, and the second section may be a second quadrant.

The carburetor main body may include a third section which is independent in operation from the first section and the second section, and the main body may include a fourth section which is independent in operation from the first section, the second section, and the third section.

The third section may be a third quadrant, and the fourth section may be a fourth quadrant.

The first section may include a first idle circuit, and the second section may include a second idle circuit.

The first idle circuit may operate independently of the second idle circuit and the first section may include a first transfer circuit.

The second section may include a second transfer circuit, and the first transfer circuit may operate independently of the second transfer circuit.

The first section may include a first main circuit, and the second section may include a second main circuit.

The first main circuit may operate independently of the second main circuit, and the carburetor assembly may include a first metering body which corresponds to the first section.

The carburetor assembly may include a second metering body which corresponds to the second section, and the first metering body may operate independently of the second metering body.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION OF PREFERRED EMBODIMENTS

Figure 1:
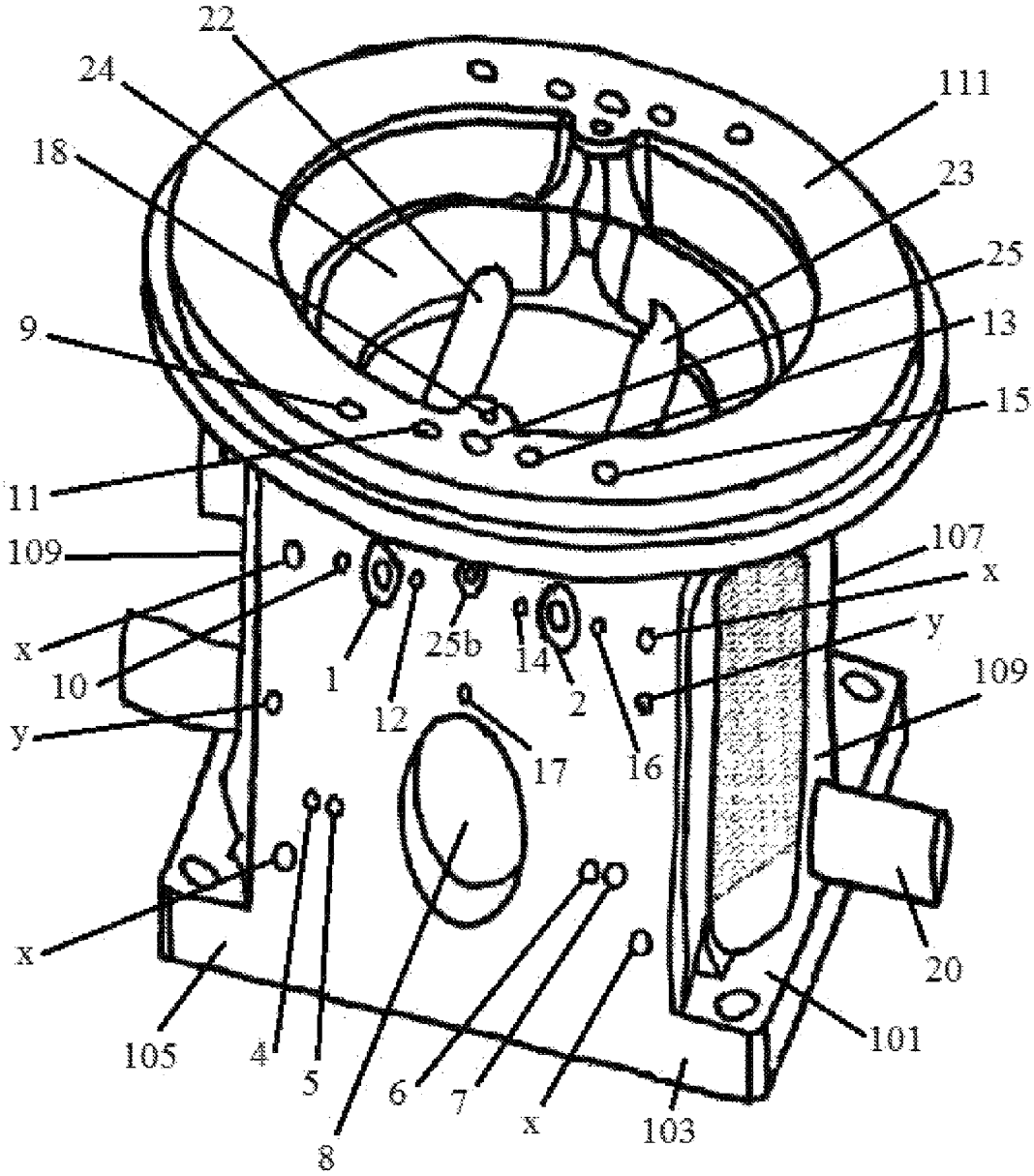
FIG. 1 is a side/top view illustration of the carburetor body embodying the disclosed invention and denoting the booster, squirter, idle, vent, power valve and transfer fuel and air bleed passages.

It is an object of the preferred embodiments to provide a single barrel carburetor for use in air demand engines.

It is further an object of the preferred embodiments to provide a number of external adjustments and interchangeable parts to allow detailed calibration and customization of a carburetor for a particular user's performance needs. These adjustments and interchangeable parts allow the engine to be more evenly tuned than current single barrel designs.

It is further an object of the preferred embodiments to create a design with reduced internal air flow (eddy resistance) as compared to prior art designs to provide increased air flow capabilities.

It is further an object of the preferred embodiments to provide a discharge booster venturi that communicates with each quadrant of the carburetor. It is further an object of the preferred embodiments to incorporate an improved method for calibrating the carburetor through a modular design with interchangeable parts.

It is further an object of the preferred embodiments to provide an improved engine carburetor which provides more horsepower.

It is further an object of the preferred embodiments to create a design with a dual bolt pattern configuration to allow it to be fitted to multiple intake manifold designs.

It is yet a further object of the preferred embodiments to provide a carburetor having "tunable" circuits, i.e., idle circuit, transfer circuit and main circuit, for each quadrant of the carburetors single body passage implemented by having interchangeable metering restrictions to allow the fuel delivery rate to be calibrated independently in each quadrant.

It is further a preferred embodiment of the design in that the throttle blade and throttle shaft can be fitted perpendicular in relation to the current preferred embodiment to allow for front to rear tuning of the single barrel design when utilizing a single metering block and bowl assembly.

A single barrel (single passage) carburetor for a high air demand engine is to be tunable in each quadrant by virtue of dedicated fuel metering devices, which may be tuned to optimize the performance of the engine. The single barrel quadrant tunable design offers improved tunability and performance over prior art.

The invention of the preferred embodiments is also directed to a method of manufacturing and calibrating single barrel carburetors. The preferred method includes a modular design and interchangeable parts.

The carburetor may be either original equipment sold with the engine or an after-market performance add-on to replace an existing carburetor on an engine. In any event, dynamometer testing has revealed that the carburetor of the preferred embodiments delivers more horsepower.

These and other objects of the preferred embodiments are particularly achieved by a single barrel assembly for an engine. The carburetor has a main body forming a body passage. This cylindrical shaped body passage is described as being equipped with an intake port, a discharge port, and a main venturi or constriction. A throttle blade is disposed within the body passage between the constriction and the discharge port. The throttle blade can be operated to regulate airflow through the body passage.

It is equipped with at least one fuel bowl assembly comprising, a fuel intake valve and a fuel bowl body as required in the modular design of the system. The fuel bowl body forms a reservoir for fuel. At least one fluid channel connects the reservoir in the fuel bowl to the body passages. Fuel enters the carburetor assembly through the fuel intake valve and accumulates in the reservoir. Fuel is aspirated as it passes through the metering block(s) and the air/fuel mixture exits the discharge end of the booster(s). This is where it is combined with air entering the intake of the body passage and this combination of fuel and air exits the discharge port into the engine.

In its most basic form, the carburetor assembly for a engine comprising: A main body forming a body passage having an intake port, a discharge port, and a constriction; a throttle valve disposed within said body passage between the constriction and the discharge port of the said body passage, said throttle valve operable to regulate airflow through said body passage; a fuel bowl assembly or assemblies comprising fuel intake valve (s) and a fuel bowl(s) forming a reservoir(s); at least one fluid channel connecting said reservoir(s) to said body passage(s), fuel is aspirated within at least one fluid channel, and aspirated fuel is combined with air entering the constricted venturi section or intake end of the body passage. Finally, the air fuel mixture exits the discharge end of the body passage.

Other objects, features and advantages of the preferred embodiments will become apparent to those skilled in the art when the detailed description of the preferred embodiments is read in conjunction with the drawings appended here. This system can function with a single bowl assembly, a single fuel metering body (metering block) assembly and a booster (if the booster is fitted without the divider option). When incorporating a single bowl assembly the design can be further improved by mounting the throttle blade and throttle shaft perpendicular to the current preferred embodiment. However the carburetor may utilize two fuel bowl and two metering assemblies and a divider in the booster assembly for even more fuel flow control over the engines demands.

With reference to the drawing figures generally, and particularly to FIG. 1 which may illustrate a carburetor main body which may include the single barrel main body assembly 24 for use in powered engines and may include a base member 101 to mount the main body assembly 24 and a front surface 105 which may be connected to opposing side surfaces 109 which may be connected to a back surface 107 which may be opposed to the front surface 105. A top surface 111 may be connected to the front surface 105, the opposing side surfaces 109 and the back surface 107 and may extend radially from the front surface 105, the opposing side surfaces 109 and the back surface 107. The carburetor 100 (shown in FIG. 3) may include a single main body 24, a single throttle shaft 20, a single throttle blade 21 (as shown on FIG. 22), a first booster 22 and second booster 23. The carburetor 100 (shown in FIG. 3) may include a fuel bowl sub assembly 113 and described in for example U.S. Pat. No. 4,034,026 incorporated by reference in its entirety or any other appropriate fuel bowl sub assembly and may include a fuel metering body 115 which may be described for example in U.S. Pat. No. 5,591,383 incorporated by reference in its entirety or other appropriate fuel metering body. Other designs may be employed with the carburetor I 00.

Figure 4:
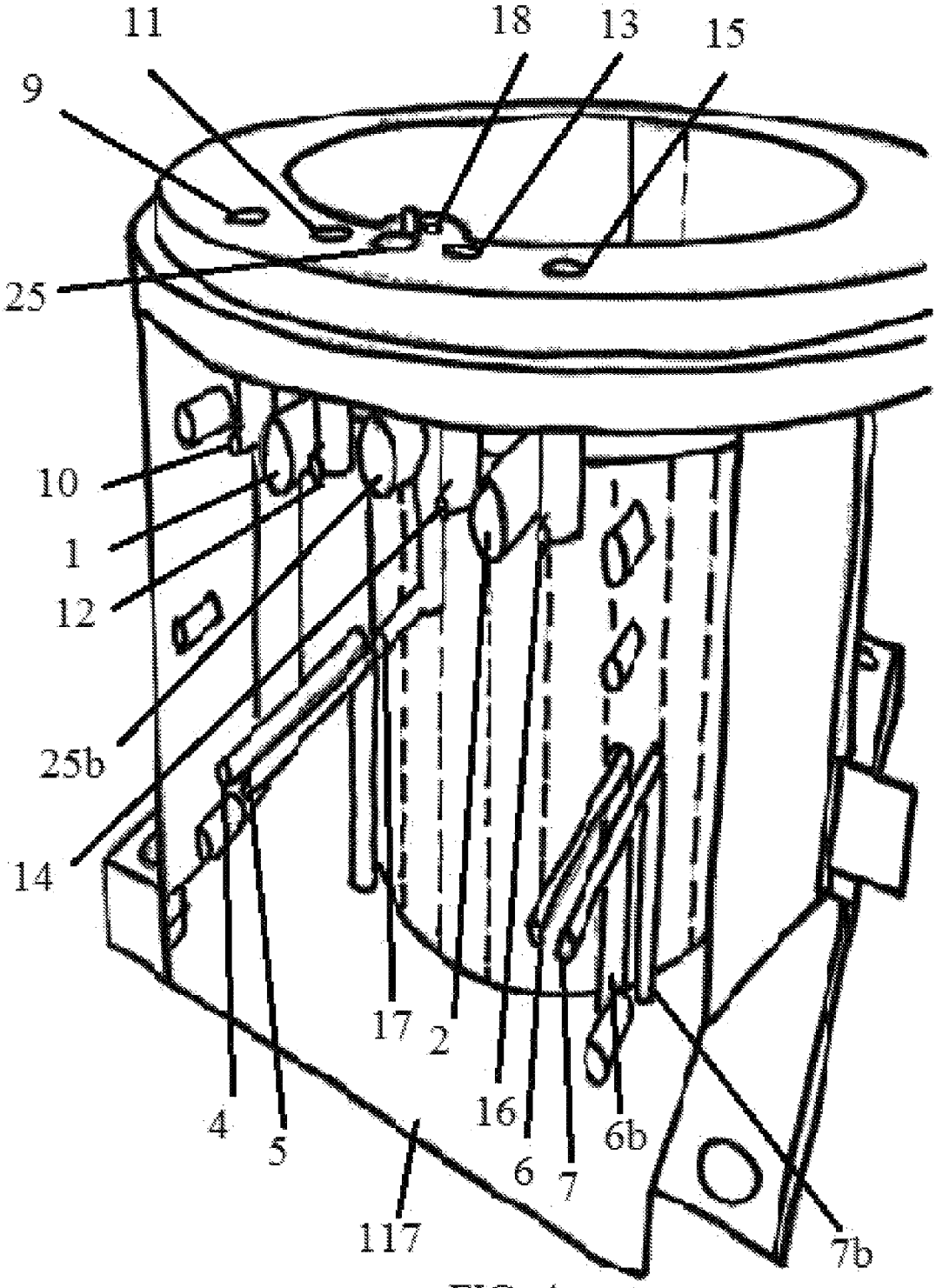
FIG. 4 illustrates the internal passages of the present invention.

The fuel bowl assembly 113 and described in U.S. Pat. No. 4,034,026 stores the fuel prior to delivery to fuel metering body 115 (metering block) assembly. The fuel metering body 115 as described in U.S. Pat. No. 5,591,383 includes a series of hydraulic and gaseous communication passages which control the fuel delivery to the carburetor 100 as a result of the throttle position and engine operating vacuum of the vehicle which may contain the carburetor 100. The main body assembly 24 may include among other components, the venturi 28 (shown in FIG. 2) and throttle blade/valve 21 (shown in FIG. 2) which are responsive to the throttle position and engine operating vacuum. The air to fuel mixture as a result of the throttle position and engine operating vacuum exit out the bottom of the main body 24 through a bottom surface aperture 28 which may be defined by the bottom surface 117 (shown on FIG. 4) which may be connected to the front surface 105, the back surface 107 and the opposing side surfaces 109 (shown on FIG. 2). This is a main body communication passage through which the air/fuel mixture is delivered to the internal combustion engine (not shown). Of course, within each of these respective sub assemblies are individual components, which collectively contribute to the fuel delivery to the internal combustion engine. These sub assembly components are discussed in more detail below and in the U.S. patent information.

Likewise, other external linkages and components are associated with these sub assemblies.

Briefly explaining these sub assemblies 113, 115, the fuel bowl assembly 113 is the portion of the carburetor 100 where fuel is delivered from fuel tank (not shown) and is stored prior to delivery to metering block assembly 115. The fuel bowl assembly 113 includes a tub body or storage area for storing fuel from the fuel tank. The fuel bowl assembly 113 may be fastened to the main body 24 and may be affixed to the main body 24 by appropriate fasteners and gaskets for connection to fastener threaded mounting holes or other appropriate fastening devices. The fuel bowl 113 may be connected by "sandwiching" the fuel metering body 115 (metering block) as it is affixed to the main body 24 by the fasteners.

Figure 3:
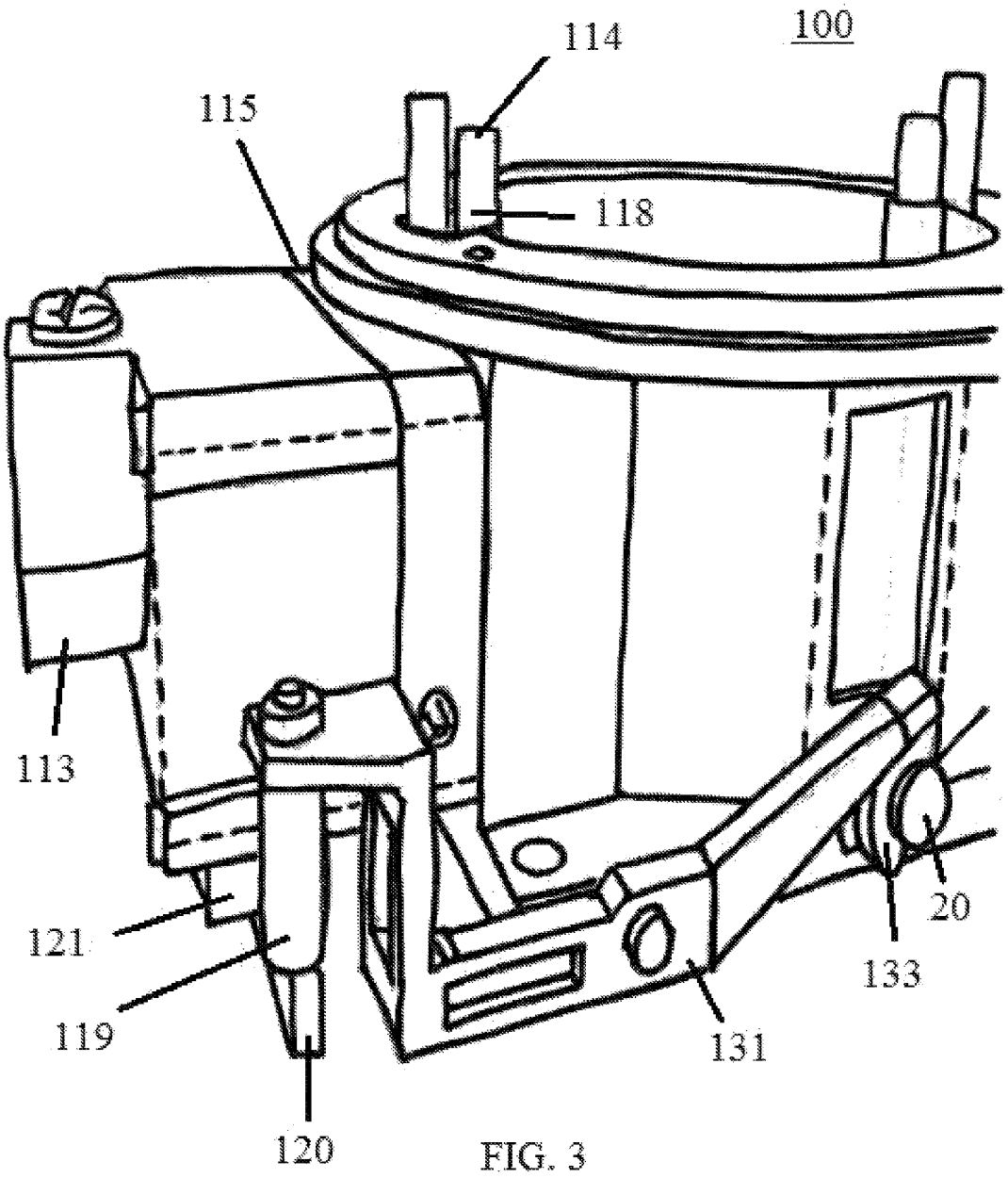
FIG. 3 is a upper side view illustration of the accelerator pump system as utilized on the preferred embodiment.

A pump diaphragm cover assembly 121 and pumping arm 120 located on the fuel bowl assembly 113 as illustrated in FIG. 3 is operated by an external lever 131 which cooperates with a pump cam 133 which rotates with the throttle shaft 20 which cooperates with the main body accelerator passage inlet 17 (shown on FIG. 1) formed in the front surface 105 and the accelerator passage outlet 18 formed in the front surface 105. In other words, upon quick acceleration or engine revving, rotation of the throttle shaft 20 activates the pump diaphragm cover assembly 121 to provide a surge of raw fuel to the carburetor 100 so that the engine does not suffer due to an inadequate fuel supply.

The fuel metering body assembly 115 (metering block) is positioned between the main body assembly 24 and the fuel bowl assembly 113.

The fuel metering body assembly 115 (metering block) includes a plate-like structure having several fluid circuits formed therein. Among other things, the fuel metering body assembly 115 conducts fuel, assists in the regulation of the aspiration of the fuel, and assists in control of the distribution of the fuel in response to the pressure gradients created in the main body assembly 24, first and second booster fluid passages 1, 2 as shown in FIG. 1.

Engine's have different fuel requirements during different phases of operation, e.g., start-up, idle, acceleration, and normal cruising operation. But on an even more fundamental level, individual cylinders of an engine have different fuel demands. Fuel must be distributed to different locations in the main body passages in different air/fuel ratios and air/fuel ratio curves as rpms and engine loads change. For this reason, the invention of the preferred embodiments employs a metering block for each quadrant that is equipped with multiple fuel channels, multiple emulsion channels and multiple jetting ports that connect to the Main body assembly 24.

Furthermore, individual cylinders of an engine typically have slightly different operating conditions. For instance, in a typical "V" shaped engine, the cylinders are required to draw from the single carburetor to the left and to the right, both longitudinally and latitudinally with respect to the other cylinder. In other words, one cylinder is positioned ahead of the other and to the side of another. As incoming air flows past a cylinder often another cylinder cuts off this flow of air and or fuel and redirects it towards itself. This air or fuel (depending on the blend percentage that is traveling in that manifold section at that point) is stolen or redirected by one cylinder intended for another. Creating either a leaner or richer condition for either cylinder than is optimal and this changes as engine rpms change. Also, we have discovered that as the single barrel design was enlarged to feed a higher horsepower engine and a much larger throttle blade was employed to increase the carburetor flow capability, uneven part throttle fuel distribution was much greater and needed to be corrected. Consequently, this led to the need for true quadrant tuning of the single venturi. What was discovered was, more fuel would be drawn into rear the engine during part throttle operation. So the fuel curve at lower rpms (lower air flow rates) needs to be leaner as it delivers fuel to the rear quadrants of the venture and then as the blade is opened fully, this rear quadrant needs to revert back to a more typical air to fuel ratio/fuel curve program that a four barrel design employs. This part throttle issue is an exclusive issue with large single blade carburetor designs and has previously not been addressed. The modular design with truly independent multiple emulsion systems for each quadrant allows the design to be capable of correcting for not only different air to fuel ratio demands in different quadrants of the single barrel, but more importantly it allows for different air to fuel ratio's to be supplied to the different quadrants of the single venture at different air speed rates and varying throttle positions. This is something prior art was not capable of achieving and there is a distinct need to correct these conditions for proper operation of these larger single barrel designs. This same preferred embodiment can be used in a dual format on a multi cylinder engine for even more control over the engines needs.

To address these different conditions and demands, the carburetor of the present invention provides for separate sections or quadrants which are individually tunable. Each section or quadrant may include a dedicated circuit which may be tuned individually. The number of sections or quadrants can be varied in accordance with the teachings of the present invention there could be two sections or quadrants, three sections or quadrants four sections or quadrants or any other number of sections or quadrants such provides each quadrant of the single barrel of the carburetor with several dedicated fuel circuits. The present invention will be explained with respect to four sections or quadrants; however, other numbers are within the scope of the present invention. Each of these circuits is individually "tunable". In other words, the fuel delivery and the air to fuel to ratio curve that the engine requires for optimal operation can be independently adjusted in this single venturi, to correct for different operating conditions and engine needs. Current single barrel carburetor designs do not offer this option and previous designs with smaller throttle blades have typically not required these options. Prior art only offered air to fuel ratio changes utilizing the same fuel ratio curve for the booster it supplied through its ports. It did not allow for individual air to fuel ratio curve tailoring to control this ratio under varying loads, throttle blade positions and rpm ranges. Consequently, the single barrel carburetor of the preferred embodiments allows the fuel delivery rate to be optimized for each of quadrant of the single barrel to assist in correcting these varying operating conditions an engine encounters as well as correcting for varying throttle blade opening positions and varying engine load rates.

Figure 2:
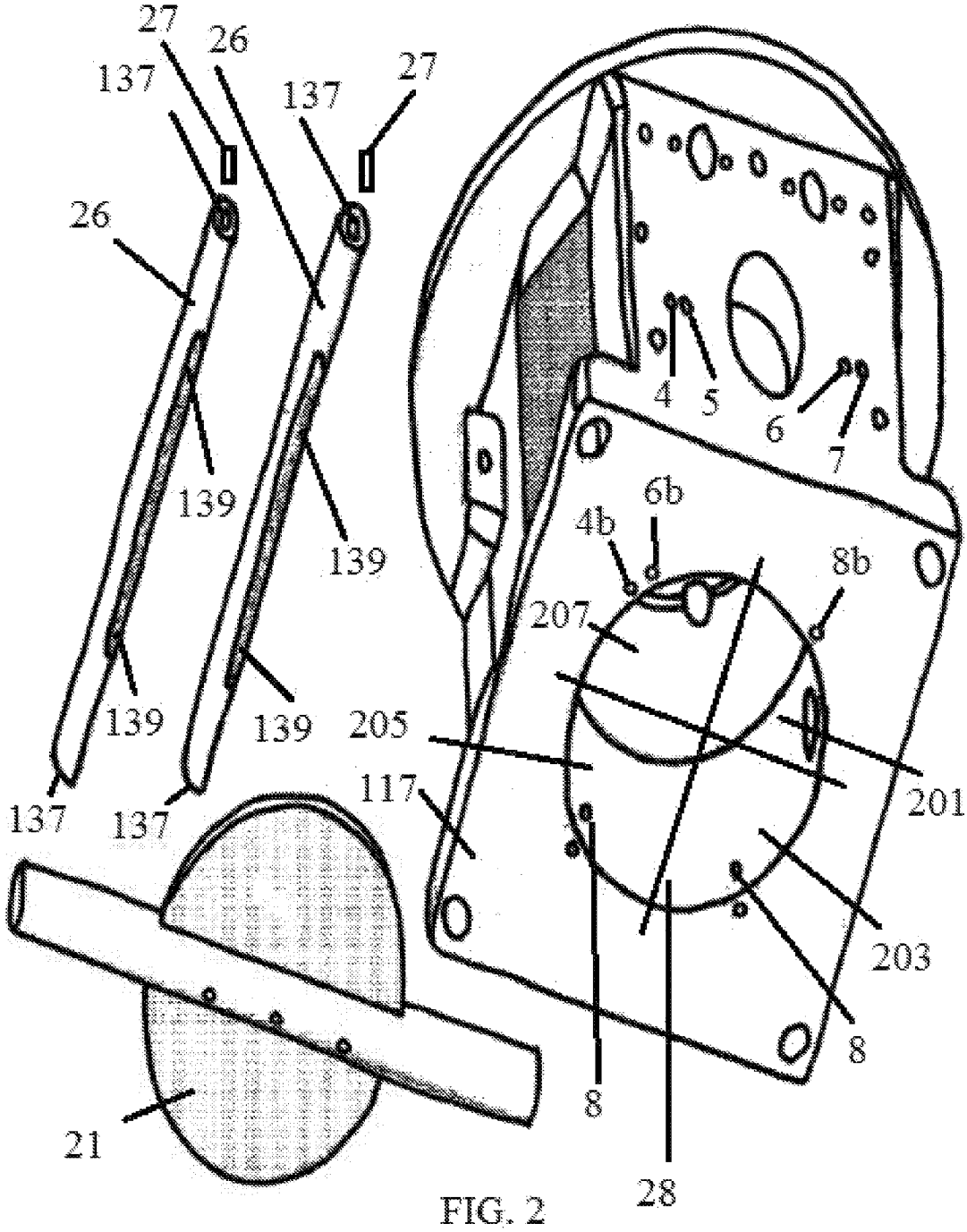
FIG. 2 is a lower bottom view of the boosters displaced from their installed positions. It shows the booster atomization holes, the booster locating pins, the machined flat surface on the boosters, a bottom view of the single barrel (discharge port) and the idle and transfer slot passages.

Now, with particular reference to quadrant tuning the single barrel with the fuel metering assemblies 115 and boosters 26 (shown on FIG. 2). These are defined by their implementation into the main body 24. The fuel metering body assembly 115 and the boosters 26 are designed and implemented to serve each respective quadrant of the single barrel and are defined by the main body 24, the boosters 26, and the fuel metering body assemblies 115 (metering blocks). Each of these components, boosters 26 and metering blocks 115, serves a respective quadrant of the single barrel. Each section or quadrant of the single barrel in the main body is served by three fluid circuits, namely, an "idle circuit", a "transfer circuit" and a "main circuit" (described below). The separate circuits permit tuning and calibration of each quadrant of the carburetor independently in response to the specific needs of that quadrant of the engine. The "circuits" are a combination of channels, air bleeds, and passages for properly mixing and directing the air and fuel.

While the circuit may be described with respect to the front surface 105, an opposing circuit is formed with respect to the back surface 107 which substantially mirrors the circuits of the front surface 105.

The "idle circuit" first passageway extends from the first inlet port 7 formed in the front surface 105 and extends to the first outlet port 7*b* formed in the upper bottom surface 117 and a second passageway which extends from the second inlet port 4 formed in the front surface 105 (shown on FIG. 2) to the second outlet 4*b* that mirrors 7 and 7*b* in design and scope. These ports exit out the bottom of the upper bottom surface 117 to form a portion of the "idle circuit" that communicates with the metering block 115 and this fuel/air mixture is subsequently directed through these passageways. These same passages are also formed on the opposite side of the main body) as it is symmetrical/mirrored in design. The "idle circuit" is the circuit through which the bulk of the low rpm (revolutions per minute) of engine speed fuel is supplied during idling conditions of the engine.

Fuel is drawn through idle passages in the main body by the vacuum created as an example at the outlet port 4*b*, 7*b* (and symmetrically on the opposing and opposite side of the main body). These exits one of which is 7*b*) open downstream of the main body throttle plate 21. During low engine rpm operating conditions, the main body throttle plate 21 is substantially closed. Consequently, a relatively large vacuum is generated on the downstream side of the throttle plate 21. Inlet port (4-7) draw fuel from the metering block and are influenced by this vacuum. Specifically, as a result of the vacuum, fuel is drawn through the metering body (metering block 115) which in turn draws fuel from the fuel bowl 113 into the first and second inlet ports 4 and 7, whereupon the fuel enters the fluid passages connecting the first and second inlet ports 4, and to the first and second outlet ports as shown as 4 and 7 and 4*b* and 7*b* (also symmetrically mounted on the opposite passage location on the opposite side of the main body) and then downstream to exit below the main body throttle plate 21 and ultimately into the engine. This fuel is the main fuel supply to power the engine during low rpm operating conditions, e.g., during idling.

A first idle air bleed passage may be defined by a first air bleed inlet port 9, 15 and the first air bleed outlet port 10, 16; a second hi speed air bleed passage may be defined by a second air bleed inlet port 11, 13 and the second air bleed outlet port 12, 14; The first and second air bleed passages are formed in the main body assembly 24 and are mirrored on the opposing side of the main body 24. These air bleed passages may be connected with channels that ultimately connect to the metering block 115 to assist in controlling and aspirating the fuel. The air bleed passages formed in the main body assembly 24 (these same passages also formed on the opposite side of the main body, as it is symmetrical in design.) permit selective adjustment of the idle operating conditions and main booster fuel delivery operating conditions by virtue of interchangeable air bleed passages corresponding to air bleed inlet ports 9, 15 and 11 and 13 as associated with the inlet side of main body assembly 24.

The "Idle circuit" air bleed passages which correspond to the air bleed inlet ports 9 and 15 denote their mounting location (also symmetrically located on the opposite side of the main body). The distal end of the respective air bleed passages for the "idle circuit", which is also formed in the main body assembly 24 additionally corresponds to the air bleed outlet ports 10 and 16 (also symmetrically located on the opposite side of the main body). These air bleed passages transport air to assist in controlling the aspiration of fuel in the metering block 115 as the block 115 simultaneously communicates with engine vacuum to the first inlet port 4 and the second inlet port 7, this simultaneous communication results in a transfer of fuel to the idle first and second passageways defined by the first inlet port 4 and the second inlet port 7 passages (shown on FIG. 1), and the first transfer passageway which may be defined by the third inlet port 6 and the third outlet port 6*b* (shown on FIG. 4 and FIG. 2) and the second transfer passageway 5 and 5*b* (shown on FIG. 2) which symmetrically opposes the port location and is mirrored on the opposite side of the main body 24.

The Idle air bleed passageways may be interchangeable for fine-tuning the amount of the air bled off during "idle and transfer circuit" operation.

When increased air flow or power is demanded, the throttle shaft is rotated in a more open position, which further opens throttle plate 21. This further opening of throttle plate 21 initiates fuel delivery through the "transfer circuit." The "transfer circuit" serves as a transition circuit between idling and booster operation. The "transfer circuit" thus supplies additional and more immediate fuel to smooth the transition from fully closed to more fully open as the engine rpms are increased. The "transfer circuit" may be a vertical slot cut or a series of holes cut in the outlet area of port 5 and 6 of the single barrel to expose an port exit 8 into the venturi area 28. The transfer holes are inline of the passage and are exposing the first transfer passageway defined by transfer port 5 and transfer port 5*b* and the transfer passageway defined by transfer port 6 and transfer port 6*b* (also mirrored on the opposite side of the main body) to discharge port vacuum when the throttle blade is lightly and even fully opened. This fuel operates as an intermediate fuel delivery circuit as throttle plate 21 is opened. In other words, beyond a certain throttle opening, the idle circuit does not contribute enough fuel to the engine for stable operation. However, the negative pressure developed in the single barrel (the main passageway through main body assembly 28) is not sufficient to activate the boosters 22,23 (shown on FIG. 1). Consequently, the transfer circuit activates and short circuits the mixture screw controlled idle circuit and delivers an increased amount of fuel from this newly exposed circuit when the blade is lightly or fully opened. This circuit continues operating until and even after the negative pressure in the boosters 22, 23 is sufficient to initiate fuel delivery.

Now, turning to the "main circuit", each of the two fuel metering blocks 115 respectively serves each half of the two boosters, 22 and 23. Each booster 22, 23 is divided into two sections. Each end of the booster tube 22 and 23 may include a axial Center aperture 137 which may extend to a point so that the center aperture 137 and the opposing center aperture 137 are not connected, and the center aperture may be formed by drilling lengthwise down its center, it is drilled down its center at a distance that is slightly less than half of its entire length, this to form a primary and secondary divider in the booster to allow fuel to travel down the center aperture 137 and may be expelled by a radial aperture 139 (shown on FIG. 2) which may extend from the center aperture 137 to the surface of the booster 22, 23 so that each of the quadrants of the single barrel may be individually supplied with fuel from the booster 22, 23. This division of the booster, the idle, the transfer circuits and subsequent employment of a modular metering block and fuel bowl configuration allows truly independent single barrel quadrant tuning capability. Each fuel metering block is equipped with main booster jetting circuits or apertures that supply metered fuel to each half of each booster it supplies. This fuel is fed to the booster from the metering block through the aperture 137. This layout contributes to the effectiveness of quadrant tuning of the single barrels air to fuel ratio. Each booster is also equipped with multiple exit apertures that assists to further atomize and these holes can be sized and relocated to properly and more evenly or unevenly (as required) distribute the aspirated fuel as it is discharged from the booster into the single barrel of the main body. FIG. 2 illustrates a first quadrant 201, a second quadrant 203, a third quadrant 205, a fourth quadrant 207 which may be individually tunable within a single barrel.

The "main circuit" also includes a first and second air bleeds passageways defined by air bleed outlet 11, 13, (also symmetrically located on the opposite side of the main body). The distal end of the first and second air bleed passageways for the "main circuit", which is also formed in the main body assembly 24, open into air bleed outlet 12, 14 (also symmetrically located on the opposite side of the main body). These channels/first and second air bleed passageway distribute controlled air supplies to assist in controlling the aspiration of fuel in the metering block 115 as the metering block 115 communicates and prior to the transfer of fuel to the main body passages. The high speed air bleed passageways are interchangeable for fine-tuning the amount of the air bled off during "main circuit" operation.

Finally, the top surface 111 of the main body assembly 24 also includes a bowl vent passage (also symmetrically located on the opposite side of the main body) which may be defined by the bowl vent inlet and outlet port 25, 25*b* and an accelerator pump channel which may be defined by an inlet and outlet accelerator pump ports 17, 18, also symmetrically located on the opposite side of the main body.

As in FIG. 1, the main body 24 includes a single barrel opening, two boosters 22, 23. These boosters 22, 23 provide constrictions in the air flow passage which creates a pressure drop. Consequently, as the air flows across the boosters at the narrowest area of the single barrel, the air is accelerated, which facilitates the atomization of fuel droplets into the air prior to delivery to the engine's cylinders. Main body 24 has one air induction passage. This air induction passage extends through the main body assembly 24.

Each booster FIG. 1 Items 22 and 23 are slid into the main body and sealed by a body mounted O-ring, each booster is located by a locating pin 27. The boosters and associated fluid feed paths are substantially identical, so just like our earlier systems, a description of one will serve to describe both. The booster has a fuel feed passage and atomization apertures 139. These fuel feed passage and atomization apertures 139 supply fuel to the single barrel of the main body 24 during off idle demand conditions.

Consequently, by virtue of having outlet ports along the length of the booster, an even distribution of fuel is provided. Because the booster is divided in half, quadrant distribution of fuel can be controlled by varying the hole size along the length of the booster as well, to optimize engine requirements. This design in turn provides a more controlled delivery of fuel into the air supply at part throttle operation as well as during wide open throttle operation.

During normal cruise conditions, i.e., when throttle plate 21 is open, air flowing across the boosters 26 creates a pressure drop at the atomization apertures 139, this communication in the form of a pressure drop is transferred to the booster channel. This same communication is then transferred to the metering block channels. This pressure drop creates a suction effect which tends to draw fuel from the channels of the metering block 115 and the fuel bowl 113. This fuel is delivered through the atomization apertures 139 on the booster 26, where the fuel is introduced and aspirated into the engines air supply flowing out through induction passage 28. As mentioned previously, a pair of boosters 22, 23 and interchangeable high speed air bleeds 11, 13 are also provided (also symmetrically located on the opposite side of the main body). High speed air bleeds 11, 13 may be interchanged to fine-tune the performance of the boosters. The high speed air bleeds 11, 13 are in fluid communication with the metering block through the main body at outlet ports 12, 14. The high speed air bleed passage "short-circuits" the suction created by boosters to reduce the amount of fuel which would be delivered to the single barrel passage if the air bleeds were not provided.

An idle air bleed inlet ports 9, 15 are also provided. The idle air bleed inlet ports 9, 15 is also interchangeable to fine-tune the performance of the idle circuit. Idle air bleed is in fluid communication with the metering block through the outlet ports 10 and 16 on the main body 24. The idle air bleed passageway defined by the inlet ports nine, 15 and the outlet ports 10, 16 also "short circuits" the suction created by idle discharge port 4*b*. 7*b* (also symmetrically located on the opposite side of the main body) to reduce the amount of fuel which would be delivered to idle discharge port 4*b*, 7*b* (also symmetrically located on the opposite side of the main body).

A pair of accelerator pump discharge nozzles 118 (pump squirters) may be positioned on the top surface 111 of the main body 24 (also symmetrically mounted on the opposite passage location on the opposite side of the main body). This accelerator pump discharge nozzle 118 (pump squirter) is in fluid communication with the accelerator passageway which may be defined by the inlet and outlet port 17, 18. Upon demanded acceleration, the throttle shaft 20 is rotated by the operator, this rotates an accelerator pump cam 133 which is affixed to the throttle shaft 131, which in turn actuates a pump arm assembly 119 which in turn actuates another lever 120 which is located on the accelerator pump housing assembly 121. This action pumps fluid into the accelerator passage. The fluid in the accelerator passage defined by the inlet port 17 and the outlet port 18 is delivered to the accelerator pump discharge nozzle 118 (pump squirter) as raw fuel (also symmetrically mounted on the opposite passage location on the opposite side of the main body). Although the raw fuel is not aspirated, the quick rotation of the throttle associated with a request for acceleration often does not provide enough time for the fuel to be properly aspirated through either of the three fluid circuits. Consequently, the raw fuel allows the engine to accelerate substantially instantaneously in response to the shaft rotation, without the engine bucking or stalling due to an inadequate fuel supply.

Advantageously, a hold down screw 114 is associated with the accelerator pump discharge nozzle 118 is interchangeable to permit selective adjustment of the fuel delivered upon demanded engine acceleration, again permitting the fine-tuning of the fuel delivery for optimum performance of the engine (also symmetrically mounted on the opposite passage location on the opposite side of the main body).

The operation of the accelerator pump system is a very standard and well known format incorporating a pump cam and levers. Other known use of items that are also only briefly described are: The throttle valve shaft Item 20 extends across the induction passage. The throttle plate Item 21 is operatively connected to the throttle valve shaft to allow it to operate and is located within the single barrel induction passage. The main body has a ledge upon it to mount a screw to adjust the idle speed as it connects with the throttle valve shaft 20. The main body has a ledge upon it to allow the throttle valve shaft 20 to have a positive stop position at wide open throttle As will now be appreciated, the single barrel quadrant tunable main body and ultimately this assembly of modular components referred to as carburetor 100 may or may not be an integral part of an engine. In operation: Fuel enters the fuel bowl assembly from the fuel tank. The fuel fills the bowl to a predetermined point based on the adjustable float assembly. The engine is primed and started and instantly creates vacuum, outside air is taken into the engine. The air passes into the main body passages and mixes air with fuel to allow the engine to run. The throttle shaft is rotated and air is drawn in and is constricted by the boosters 22 and 23 creating a pressure drop compared to atmospheric pressure and the pressure within the fluid channels of the fuel metering body assembly allow fuel to flow through the boosters. This fuel is then delivered to the engine through the metering block and boosters and the aspirated fuel is mixed with the incoming air through the single barrel after the various air bleeds to emulsify and aspirate the fuel have done their work. The actual path of the fuel through the various metering systems and main body assembly is determined by the phase of the throttle position and engine vacuum created. The mixture is then delivered to the engine's combustion chambers and power is created inside the engine.

While the examples given in the specification and drawings relate to a multi cylinder application, it is noted that the invention can be adapted to single cylinder engines as well as its intended multi cylinder application.

This invention has been described in connection with preferred embodiments. These embodiments are intended to be illustrative only. It will be readily appreciated by those skilled in the art that modifications may be made to these preferred embodiments without departing from the scope of the invention.

Without being limited to any theory of operation, it is believed that the provision of a communication path to correct air to fuel ratios in a controllable curve in each quadrant of the single barrel passage provides unique advantages, not the least of which is the increased horsepower and improved engine operation and idle quality which has been observed on a dynamometer and in professionally certified live testing has also been vastly improved over prior art.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

What is claimed is:

1. A carburetor main body assembly for an engine, comprising:

a main body;

the main body comprising a single body passage and a single throttle plate;

the single body passage comprising a single intake port and a single discharge port;

the single intake port being connected to the single discharge port;

the single discharge port being connected to a plenum of the engine;

the single throttle plate being disposed within the single body passage;

the throttle plate being operable to regulate airflow through the single body passage;

the main body further comprising a first section to supply fuel to the engine and a second section to supply fuel to the engine;

the first section being independent in operation from the second section; and the second section being a second quadrant.

2. The carburetor main body assembly for the engine of claim 1 further comprising:

the first section being a first quadrant.

3. The carburetor main body assembly for the engine of claim 1 further comprising:

the main body further comprising a third section; and the third section being independent in operation from the first section and the second section.

4. The carburetor main body assembly for the engine of claim 3 further comprising:

the main body further comprising a fourth section; and the fourth section being independent in operation from the first section, the second section and the third section.

5. The carburetor main body assembly for the engine of claim 1 further comprising:

the first section comprising a first idle circuit.

6. The carburetor main body assembly for the engine of claim 5 further comprising:

the second section comprising a second idle circuit.

7. The carburetor main body assembly for the engine of claim 6 further comprising:

the first idle circuit operating independently of the second idle circuit.

8. The carburetor main body assembly for the engine of claim 1 further comprising:

the first section comprising a first transfer circuit.

9. The carburetor main body assembly for the engine of claim 8 further comprising:

the second section comprising a second transfer circuit.

10. The carburetor main body assembly for the engine of claim 9 further comprising:

the first transfer circuit operating independently of the second transfer circuit.

11. The carburetor main body assembly for the engine of claim 1 further comprising:

the first section comprising a first main circuit.

12. The carburetor main body assembly for the engine of claim 11 further comprising:

the second section comprising a second main circuit.

13. The carburetor main body assembly for the engine of claim 12 further comprising:

the first main circuit operating independently of the second main circuit.

14. The carburetor main body assembly for the engine of claim 1 further comprising:

a first metering body; and the first metering body corresponding to the first section.

15. The carburetor main body assembly for the engine of claim 14 further comprising:

a second metering body; and the second metering body corresponding to the second section.

16. The carburetor main body assembly for the engine of claim 15 further comprising:

the first metering body operating independently of the second metering body.

* * * * *